US007594464B2

(12) United States Patent
Dueck

(10) Patent No.: US 7,594,464 B2
(45) Date of Patent: Sep. 29, 2009

(54) SOUND SUPPRESSORS FOR FIREARMS

(75) Inventor: Barry W. Dueck, Corona, CA (US)

(73) Assignee: Surefire, LLC, Fountain Valley, CA (US)

( * ) Notice: Subject to any disclaimer, the term of this patent is extended or adjusted under 35 U.S.C. 154(b) by 188 days.

(21) Appl. No.: 11/711,430

(22) Filed: Feb. 26, 2007

(65) Prior Publication Data

US 2007/0266844 A1 Nov. 22, 2007

Related U.S. Application Data

(60) Provisional application No. 60/788,915, filed on Apr. 3, 2006.

(51) Int. Cl.
*F41A 21/00* (2006.01)

(52) U.S. Cl. ..... 89/14.4; 89/14.2

(58) Field of Classification Search ..... 89/14.2, 89/14.3, 14.4, 14.1, 14.5
See application file for complete search history.

(56) References Cited

U.S. PATENT DOCUMENTS

| | | | | |
|---|---|---|---|---|
| 4,576,083 | A | 3/1986 | Seberger, Jr. | |
| 4,907,488 | A | 3/1990 | Seberger | |
| 5,092,223 | A * | 3/1992 | Hudson | 89/14.2 |
| 6,948,415 | B2 | 9/2005 | Matthews et al. | |
| 7,062,874 | B1 | 6/2006 | Smith | |
| 7,143,680 | B2 * | 12/2006 | Bender | 89/14.3 |
| 7,207,258 | B1 * | 4/2007 | Scanlon | 89/198 |
| 2006/0060076 | A1 | 3/2006 | Dueck et al. | |

* cited by examiner

*Primary Examiner*—Michael Carone
*Assistant Examiner*—Gabriel J Klein
(74) *Attorney, Agent, or Firm*—David Weiss

(57) ABSTRACT

Firearm sound suppressor apparatus comprising a sound suppressor body including a sound suppressing front section and a back section, the back section adapted to coaxially receive a muzzle fixture secured to the firearm, the back section configured with at least three interrelated chambers when the muzzle fixture is received by the back section for effecting energy attenuation of at least a portion of combustion gases exiting the muzzle fixture from the firing of the firearm.

6 Claims, 2 Drawing Sheets

SOUND SUPPRESSORS FOR FIREARMS

CROSS-REFERENCE TO RELATED APPLICATION

This application claims the benefit of U.S. Provisional Application No. 60/788,915, filed Apr. 3, 2006, which application is incorporated herein by reference.

BACKGROUND OF THE INVENTION

This invention relates to sound suppressor apparatus for firearms, and more particularly to a sound suppressor having a back section configured in relation to a muzzle fixture of a firearm for improving sound suppression.

Sound suppressors for firearms conventionally include a generally cylindrical sound suppressor body including a sound suppressing front section and a back section adapted to be secured to the firearm. The back section may be directly secured to the firearm muzzle, or it may be secured to a muzzle fixture (such as a flash suppressor, muzzle brake, compensator or adapter) which is secured to the firearm's muzzle.

Sound suppressors are known in the art that include a back section having one or two chambers for receiving combustion gases exiting from the firearm's muzzle upon the firing of the firearm and for applying those gases to the sound suppressor's front end. For example, a dual chamber back section is shown in combination with a muzzle fixture such as a flash suppressor in U.S. Pat. No. 6,948,415 to John W. Matthews et al., assigned to the assignee of the present application, while a dual chamber back section is shown (without provision of a flash suppressor or other muzzle fixture) in U.S. Pat. No. 4,907,488 to Oswald P. Seberger.

There nevertheless exists a need for firearm sound suppressors with improved overall sound suppressor performance, which need is fulfilled by the back section configuration of sound suppressors in accordance with the present invention.

SUMMARY OF THE INVENTION

The present invention provides a sound suppressor having a back section configured with at least three interrelated chambers in association with a muzzle fixture, for significantly improving overall sound suppressor performance. According to one aspect of the present invention, there is provided a sound suppressor apparatus for a firearm having a barrel extending along a longitudinal axis, comprising: a muzzle fixture for the firearm, the muzzle fixture including an axial passageway and a lateral vent; and a sound suppressor body including a sound suppressing front section and a back section, the back section adapted to coaxially receive the muzzle fixture, the back section configured with at least three interrelated chambers when the muzzle fixture is received by the back section for effecting energy attenuation of at least a portion of combustion gases exiting the muzzle fixture from a firing of the firearm when the muzzle fixture is secured to the barrel.

In its preferred embodiment, the sound suppressor apparatus for a firearm having a barrel extending along a longitudinal axis, comprises: a muzzle fixture for the firearm, the muzzle fixture including an axial passageway and a lateral vent; and a sound suppressor body including a sound suppressing front section and a back section, the back section adapted to coaxially receive the muzzle fixture, the back section including a forward chamber communicating with the front section and situated generally forwardly of the muzzle fixture when the muzzle fixture is received by the back section, a first lateral chamber communicating with the vent when the muzzle fixture is received by the back section, and a second lateral chamber, the second lateral chamber and the forward chamber communicating with each other. The first lateral chamber is situated about the muzzle fixture when the muzzle fixture is received by the back section, and the second lateral chamber is situated about the first lateral chamber.

In the preferred embodiment, the muzzle fixture includes a forward portion which includes the vent; the forward chamber includes a forward facing annular wall about an opening to the axial passageway of the muzzle fixture when the muzzle fixture is received by the back section; the lateral chamber circumferentially surrounds the front portion of the muzzle fixture when the muzzle fixture is received by the back section; and the second lateral chamber circumferentially surrounds the first lateral chamber. The back chamber preferably includes ports about the annular wall of the forward chamber for enabling the second lateral chamber and the forward chamber to communicate with each other.

BRIEF DESCRIPTION OF THE DRAWINGS

The novel features believed to be characteristic of the present invention, together with advantages thereof, will be understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENTS

Figure 1:
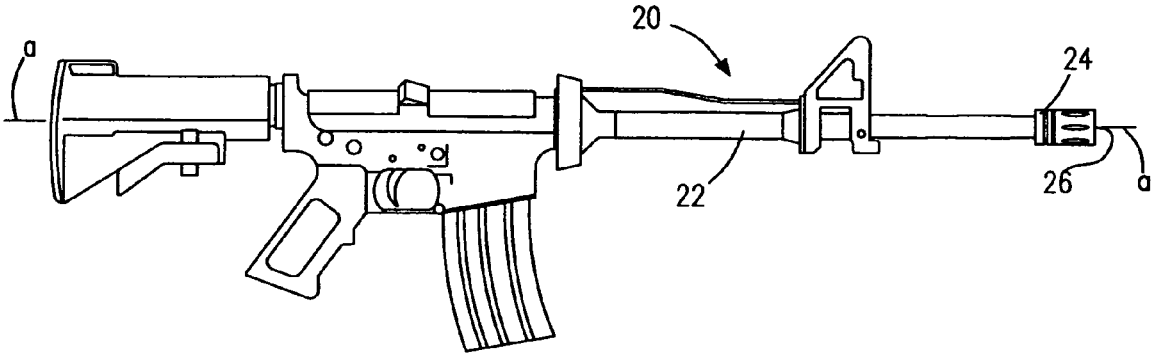
FIG. 1 is a side view of a firearm equipped with a muzzle fixture, specifically a flash suppressor, which may be used in combination with a preferred embodiment of a sound suppressor according to the present invention.

Turning to the drawings, there is illustrated in FIG. 1 an example of a firearm 20, such as an M-4 or M-16 automatic rifle, to which a firearm accessory, in particular a sound suppressor according to the present invention, may be removably secured. The firearm 20 includes a barrel 22 having a longitudinal axis a along which a fired bullet is caused to travel. The firearm's muzzle is equipped with a flash suppressor 24 (although another type of muzzle fixture may be employed, such as a muzzle brake, compensator or adapter) having a forward opening 26 through which the fired bullet exits. The flash suppressor 24 or other muzzle fixture may be fixedly secured to the firearm barrel 22 such as by welding or other conventional securement means (for example, by means of mating threads externally about the barrel muzzle and internally of the flash suppressor together with a high-temperature cement or a locking device for preventing rotation of the installed flash suppressor 24 with respect to the firearm barrel 22), or the muzzle end portion of the firearm barrel 22 may be machined in the configuration of the flash suppressor 24.

As used herein, the word "front" or "forward" corresponds to the firing direction of the firearm 20 (i.e., to the right as shown in FIGS. 1, 2, 4, 5, 6 and 8); "rear" or "rearward" corresponds to the direction opposite the front or forward direction; and "longitudinal" means the direction along or parallel to the longitudinal axis a of the barrel 22 of the firearm 20, or to the longitudinal axis a' of the sound suppressor assembly 38.

Figure 2:
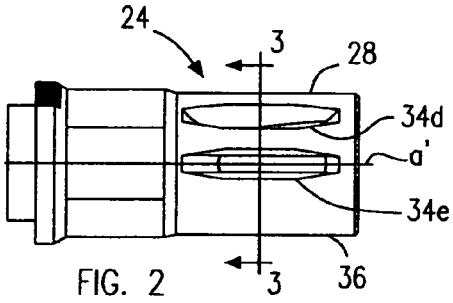
FIG. 2 is a side view of the flash suppressor shown in FIG. 1.
Figure 3:
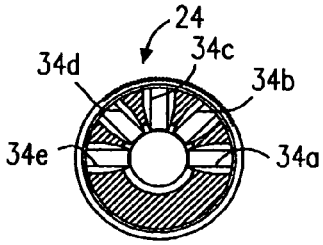
FIG. 3 is a cross-sectional view of the flash suppressor of FIG. 2, taken along the line 3-3 of FIG. 2 and viewed in the direction of the appended arrows.
Figure 4:
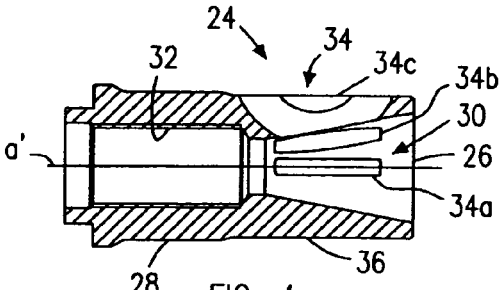
FIG. 4 is a longitudinal cross-sectional view of the flash suppressor of FIG. 2.

As shown in FIGS. 2-4, an example of the flash suppressor 24 includes a generally cylindrical wall 28 with a forward portion 36 including an axial passageway 30 and a vent 34 through the wall 28 of the flash suppressor's forward portion 36, although it may be appreciated that other vented muzzle fixtures may be used as well. The axial passageway 30 is forwardly of and communicates with a threaded bore 32 for threadedly securing the flash suppressor 24 to the threaded muzzle end of the firearm barrel 22. The lateral vent 34 is preferably symmetrically distributed through the forward portion 36 and typically comprises at least one slot through the wall 28, longitudinally extending along and circumferentially evenly spaced about a sector of the forward portion 36 of the flash suppressor 24. In the example of the flash suppressor 24 shown in FIGS. 2-4, the longitudinally extending lateral slots are five in quantity (referred to individually as slots 34*a*, 34*b*, 34*c*, 34*d* and 34*e*, and referred to collectively as the vent 34 or slots 34), and are rotationally spaced about an approximately 180° sector of the forward portion 36. Proper installation of the flash suppressor 24 to the muzzle end of the firearm barrel 22 would require that the middle slot 34*c* (i.e., the third slot in this five-slot vent 34) be at the twelve o'clock or top dead center position of the barrel 22. Techniques for such installation of the flash suppressor 24 (as well as other vented muzzle fixtures) are discussed in U.S. patent application Ser. No. 11/015,685, filed Dec. 16, 2004, of Brooke C. Smith, assigned to the assignee of the present application and incorporated in full herein by reference.

Figure 5:
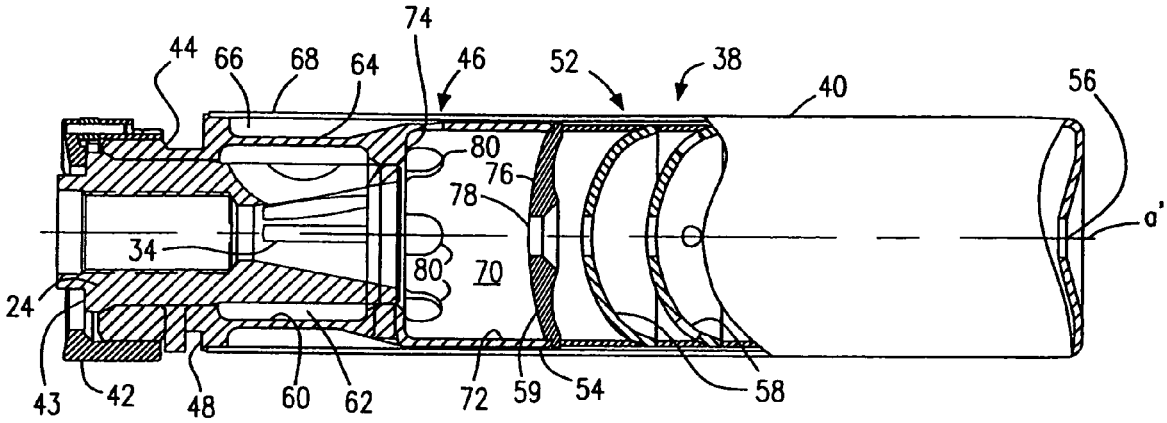
FIG. 5 is a longitudinal cross-sectional view of a preferred embodiment of a sound suppressor assembly according to the present invention, including the flash suppressor shown in FIGS. 2-4.
Figure 6:
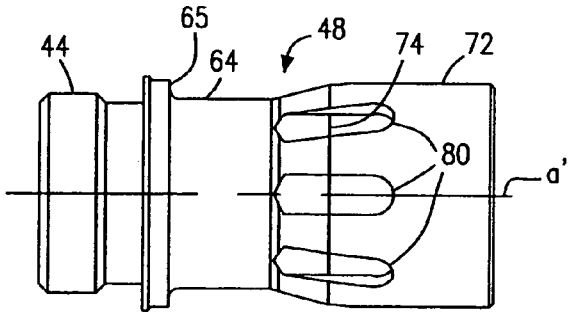
FIG. 6 is a side elevation view of a preferred embodiment of the sound suppressor's back section component shown in FIG. 5.

The preferred embodiment of a sound suppressor assembly 38 of the present invention, represented in FIG. 5, comprises a generally cylindrical sound suppressor body 40 having a longitudinal axis a', removably secured to the flash suppressor 24. For example, a retaining ring 42 cooperatively engages a ridge 43 near the rear end of the flash suppressor 24 and a rear collar 44 of the sound suppressor body 40, such as taught in U.S. Pat. No. 6,948,415 to John W. Matthews et al. and assigned to the assignee of the present application, and in U.S. patent application Ser. No. 11/171,178 filed Jun. 29, 2005, of Barry W. Dueck et al. and assigned to the assignee of the present application. U.S. Pat. No. 6,948,415 and application Ser. No. 11/171,178 are incorporated in full herein by reference.

Figure 7:
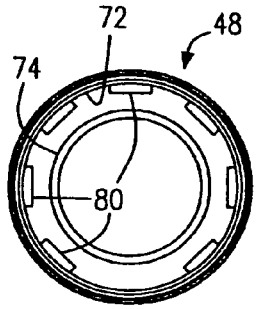
FIG. 7 is a front end view of the back section component of FIG. 6.
Figure 8:
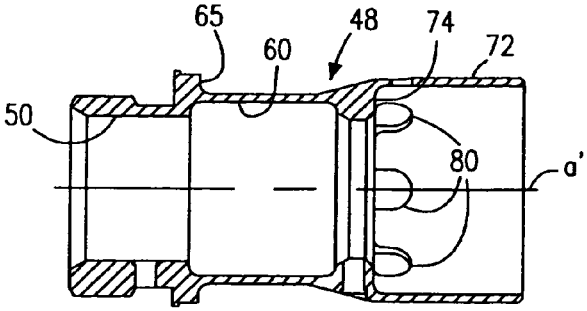
FIG. 8 is a longitudinal cross-sectional view of the back section component of FIGS. 6 and 7.

The sound suppressor body 40 comprises a back section 46 including a back section component 48 (see also FIGS. 6-8) having a longitudinal bore 50 for coaxially receiving the flash suppressor 24. The sound suppressor body 40 further includes a main sound suppressing front section 52 fixedly secured to the back section 46 (for example, by welding along their circumferences as at 54) and having an axial exit opening 56 through which a fired bullet exits when the sound suppressor body 40 is secured to the flash suppressor 24 which itself is secured to the firearm barrel 22, with the longitudinal axes a and a' coinciding. Sound suppressor front sections are well known in the sound suppressor art, typically including a series of baffles (represented by the baffles 58 in FIG. 5) forwardly of a first or "blast" baffle 59, successively deflecting combustion gases resulting from the firearm's firing of a bullet and for thereby muffling the sound consequent thereto. Sound suppressors including baffled front sections are disclosed, for example, in U.S. Pat. Nos. 4,576,083 and 4,907,488, to Oswald P. Seberger, incorporated in full herein by reference.

The present invention provides a back section 46 which increases the overall sound suppressing performance of a sound suppressor by decreasing the work required by the main sound suppressing front section 52. This is accomplished by configuring the sound suppressor's back section 46 in relation to the flash suppressor 24 such that at least three interrelated chambers are formed in the back section for preprocessing portions of the combustion gases before introducing such portions to the sound suppressor's front section.

Specifically, a portion of the bore 50 of the back section component 48 is of increased diameter so that, when the flash suppressor 24 is received by the back section component bore 50 and the sound suppressor body back section 46 is removably secured to the flash suppressor 24 as previously described and shown in FIG. 5, the increased diameter bore portion 60 of the back section component 48 circumferentially surrounds the forward portion 36 of the flash suppressor 24, forming a first lateral chamber 62 about the flash suppressor's forward portion 36 and communicating with the flash suppressor's vent slots 34.

The outer surface of the back section component 48 includes a recess 64 between a rear annular flange 65 and the tubular front side wall 72, the recess 64 forming a second lateral chamber 66 with the tubular housing 68 fixedly secured to the back section component 48.

The sound suppressor back section 46 further includes a forward chamber 70 situated generally forwardly of the installed flash suppressor 24. The forward chamber 70 is defined by the tubular front side wall 72 of the back section component 48, a forward facing annular wall 74 inwardly extending from the tubular front side wall 72, and the rear surface 76 of the blast baffle 59. The forward chamber 70 is open to the axial passageway 30 of the flash suppressor 24 at the flash suppressor's forward opening 26, which may extend into the forward chamber 70, and the forward chamber 70 communicates with the sound suppressor's front section 52 through a central aperture 78 through the blast baffle 76. The forward chamber 70 and the second lateral chamber 66 communicate with each other, such as through a series of ports 80 extending through the tubular front wall 72 about the annular wall 74 of the forward chamber 70 and into the second lateral chamber 66.

Upon firing of a bullet by the firearm 20 to which the sound suppressor assembly 36 is secured with the longitudinal axis a' coinciding with the longitudinal axis a, the bullet proceeds axially through the flash suppressor passageway 30, the forward chamber 70, the blast baffle central aperture 78 and axial openings through the sound suppressor front section 52, finally exiting through the axial exit opening 56 at the sound suppressor's front end.

Although the sound suppression mechanism of the three interrelated chambers of the preferred embodiment of the present invention is not completely understood, it is believed that the firearm's combustion gases incident to the bullet's firing, which follow the bullet through the barrel 22, proceed through the flash suppressor's axial passageway 30 and into the back section's forward chamber 70 while a portion of those gases are diverted through the flash suppressor's vent slots 34 into the first lateral chamber 62. The gases filling the first lateral chamber 62 proceed back through the flash suppressor's vent slots 34 to mix with the gases in the forward chamber 70. The fired bullet's momentary blocking of the blast baffle's axial aperture 78 enables much of the gases in the forward chamber 70 to be deflected by the rearward surface 76 of the blast baffle 59, by the forward chamber's tubular side wall 72 and by the forward facing annular wall 74. A portion of the deflected gases enters the second lateral chamber 66 through the forward chamber's side ports 80, and gases from the filled second lateral chamber 66 reenter the forward chamber 70 through the side ports 80. Such rebounding of the gases and their interaction among the three chambers of the back section 46 continues with consequent energy attenuation, and with the gases including the energy attenuated gases proceeding through the blast baffle aperture 78 and into the sound suppressor's front section 52 to interact with the baffles 58 with resulting overall sound suppression efficiency.

Thus, there has been described a preferred embodiment of a firearm sound suppressor having a back section configured in relation to the firearm's muzzle fixture such that at least three interrelated chambers are formed in the back section for preprocessing portions of the combustion gases before such portions are processed by the sound suppressor's front section. Other embodiments of the present invention, and variations of the embodiment described herein, may be developed without departing from the essential characteristics thereof. Accordingly, the invention should be limited only by the scope of the claims listed below.

I claim:

1. Apparatus comprising:

a firearm having a barrel extending along a longitudinal axis;

a muzzle fixture secured to said barrel and having an axial passageway along said longitudinal axis and a lateral vent; and a sound suppressor body including a sound suppressing front section and a back section receiving said muzzle fixture, said back section including a forward chamber communicating with said front section and situated generally forwardly of said muzzle fixture, a first lateral chamber communicating with said vent, and second lateral chamber, said second lateral chamber and said forward chamber communicating with each other, and wherein: said muzzle fixture includes a forward portion including said vent; said forward chamber includes a forward facing annular wall about an opening to said axial passageway of said muzzle fixture; said first lateral chamber circumferentially surrounds said forward portion of said muzzle fixture; and said second lateral chamber circumferentially surrounds said first lateral chamber.

2. The apparatus according to claim 1, wherein:

said back section includes ports about said annular wall of said forward chamber enabling said second lateral chamber and said forward chamber to communicate with each other.

3. Sound suppressor apparatus for a firearm having a barrel extending along a longitudinal axis, comprising:

a muzzle fixture for the firearm, said muzzle fixture including an axial passageway and a lateral vent; and a sound suppressor body including a sound suppressing front section and a back section, said back section having a longitudinal axis and adapted to coaxially receive said muzzle fixture, said back section including a forward chamber communicating with said front section and situated generally forwardly of said muzzle fixture when said muzzle fixture is received by said back section, a first lateral chamber communicating with said vent when said muzzle fixture is received by said back section, and a second lateral chamber, said second lateral chamber and said forward chamber communicating with each other, and wherein: said muzzle fixture includes a forward portion including said vent; said forward chamber includes a forward facing annular wall about an opening to said axial passageway of said muzzle fixture when said muzzle fixture is received by said back section; said first lateral chamber circumferentially surrounds said forward portion of said muzzle fixture when said muzzle fixture is received by said back section; and said second lateral chamber circumferentially surrounds said first lateral chamber.

4. The apparatus according to claim 3, wherein:

said back section includes ports about said annular wall of said forward chamber for enabling said second lateral chamber and said forward chamber to communicate with each other.

5. Sound suppressor apparatus for a firearm with a muzzle fixture, the muzzle fixture including a passageway extending along a longitudinal axis and a lateral vent, the sound suppressor apparatus comprising:

a sound suppressor body including a sound suppressing front section and a back section having a longitudinal axis, said back section adapted to coaxially receive the muzzle fixture, said back section including a forward chamber communicating with said front section and situated generally forwardly of the muzzle fixture when said muzzle fixture is received by said back section, a first lateral chamber communicating with said vent when the muzzle fixture is received by said back section, and a second lateral chamber, said second lateral chamber and said forward chamber communicating with each other, and the muzzle fixture including a forward portion including a vent, wherein: said forward chamber includes a forward facing annular wall about an opening to the axial passageway of the muzzle fixture when the muzzle fixture is received by said back section; said first lateral chamber circumferentially surrounds said forward portion of the muzzle fixture when the muzzle fixture is received by said back section; and said second lateral chamber circumferentially surrounds said first lateral chamber.

6. The apparatus according to claim 5, wherein:

said back section includes ports about annular wall of said forward chamber enabling said second lateral chamber and said forward chamber to communicate with each other.

* * * * *